United States Patent [19]

Campbell et al.

[11] Patent Number: 4,611,214

[45] Date of Patent: Sep. 9, 1986

[54] TACTICAL HIGH FREQUENCY ARRAY ANTENNAS

[75] Inventors: Donn V. Campbell; Palemon W. Dubowicz; Felix Schwering, all of Eatontown, N.J.

[73] Assignee: The United States of America as represented by the Secretary of the Army, Washington, D.C.

[21] Appl. No.: 624,896

[22] Filed: Jun. 27, 1984

[51] Int. Cl.[4] ..... H01Q 9/32; H01Q 5/01

[52] U.S. Cl. ..... 343/790; 343/834; 343/826

[58] Field of Search ..... 343/834–837, 343/843–846, 885, 825, 826, 830, 829, 790, 792, 731–740, 729, 730, 850, 853

[56] References Cited

U.S. PATENT DOCUMENTS 3,576,578 4/1971 Harper ..... 343/792
3,961,331 6/1976 Campbell ..... 343/792

OTHER PUBLICATIONS

"The Half Square Antenna", B. Vester, QST, Mar., 1974, pp. 11–14.

*Primary Examiner*—Eli Lieberman
*Assistant Examiner*—Michael C. Wimer
*Attorney, Agent, or Firm*—Anthony T. Lane; Jeremiah G. Murray; Edward Goldberg

[57] ABSTRACT

A vertically polarized array comprised of both bottom fed and top fed configurations having a driven element comprising at least one but, when desirable, two generally horizontal wire conductor segments of a length substantially equal to one half the operating wavelength of the array and with the ends of the half-wave conductor segments being connected to or extending into generally vertical quarter wavelength wire conductor segments. In a bottom fed configuration the feedpoint is at the bottom end of one vertical quarter wavelength conductor segment while in a top fed configuration one vertical quarter wavelength segment comprises a quarter wavelength of coaxial transmission line having one end configured into signal isolation means, comprising a cable choke, while the feedpoint is located at the other end. Behind the array, located at a distance of substantially a quarter wavelength, is a parasitic reflector element comprising a substantially identical structure as the driven element with the lower ends of the vertical quarter wavelength elements thereof positioned a foot or two above the surface of the ground. Such an arrangement provides unidirectional radiation and reception at low take-off angles, e.g. 20° above the horizon.

13 Claims, 8 Drawing Figures

λ/4
λ/2
REFLECTOR, 18
20
22
12
26
14
DRIVEN ELEMENT, 10
FEED POINT, 34
48
32
44
36
52
38
50
46
40
24
λ/4
16
28
X
42
MAXIMUM RADIATION
54
31
30

λ/4
λ/2
16a
24a
22a
REFLECTOR, 18'
14a
λ/2
DRIVEN ELEMENT, 10'
14b
20
22b
31a
12
24b
32
FEED POINT, 34
MAXIMUM RADIATION
44
52
36
λ/4
46
38
16b
40
42
54
31b

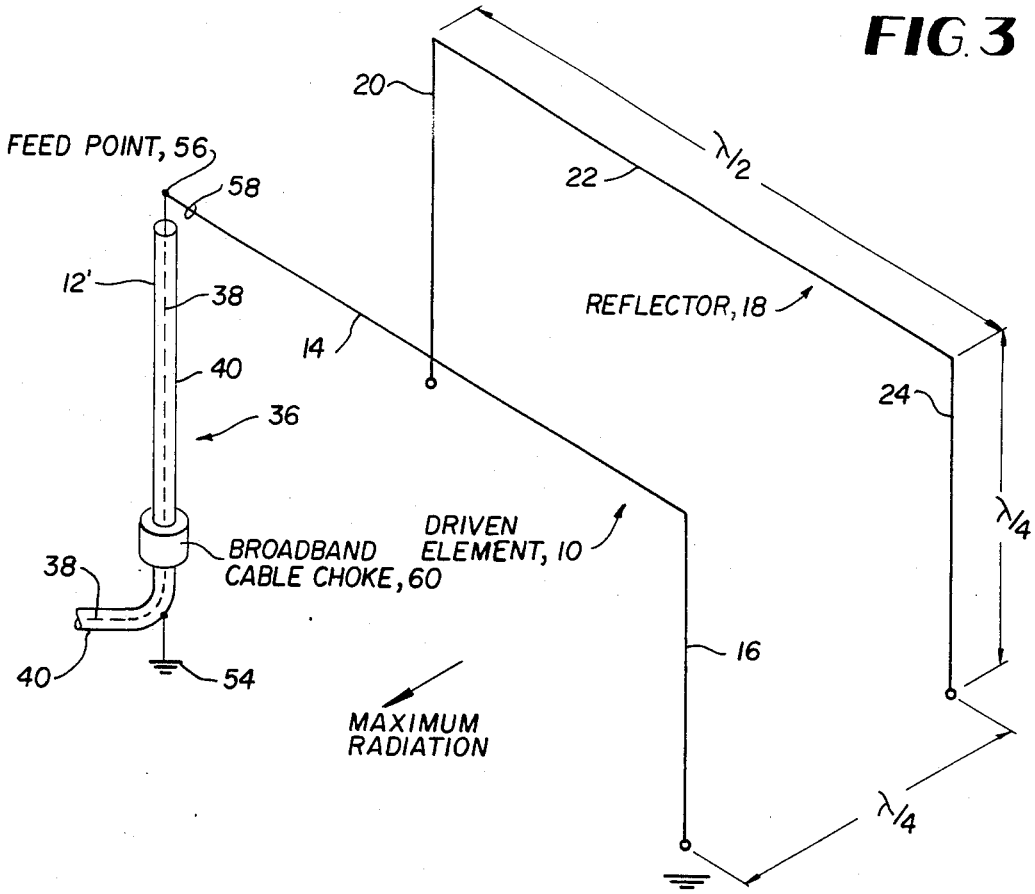
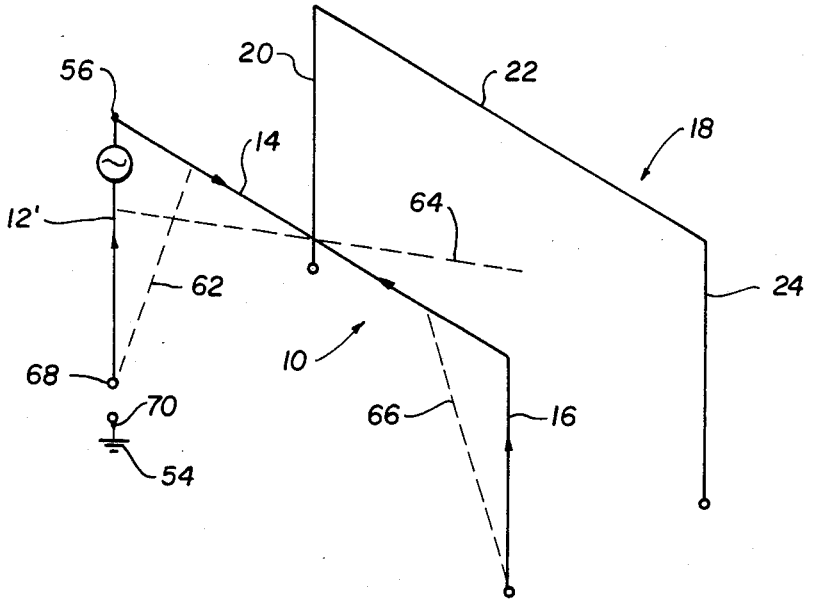
FIG. 4

TACTICAL HIGH FREQUENCY ARRAY ANTENNAS

The invention described herein may be manufactured and used by or for the Government for governmental purposes without the payment of any royalties thereon or therefor.

BACKGROUND OF THE INVENTION

The present invention relates generally to antennas of electromagnetic radiation and more particularly to a multi-element broadside vertical array.

In military applications there exists a need for a high performance, light weight portable antenna which provides unidirectional radiation and reception of high frequency radio waves at low take off angles above the horizon in a compact configuration and which is particularly adapted for field use and can operate to provide communications in the HF or high frequency band (2 MHz–30 MHz) of the electromagnetic spectrum over medium range and long range ionospheric circuits.

One known type of radio antenna comprises what is referred to as the broadside vertical array and consists of a multi-element array configured of horizontal half wavelength conductors and vertical quarter wavelength conductors typically configured in what is referred to as either a half square array consisting of a single horizontal half wavelength conductor element whose ends extend into or are connected to a pair of vertical quarter wavelength conductor elements with a feed point being located at the bottom of one of the quarter wavelength conductors, or a double half square array also known as a "bobtail" array consisting of a pair of horizontal half wavelength conductor elements mutually connected together at one end by a vertical quarter wavelength conductor element and which includes a feed point at the bottom thereof and two outer vertical quarter wavelength conductor elements which are extensions of or are attached to the outer ends of the two half wavelength conductor elements. Such apparatus, moreover, has been shown and disclosed in a publication entitled, "The Half Square Antenna", which was published in the March, 1974 issue of *QST* of the American Radio Relay League by B. Vester at pp. 11–14.

Accordingly, it is an object of the present invention to provide improvement in high frequency communications antennas.

It is another object of the invention to provide an improvement in high frequency multi-element broadside vertical array antennas.

Still another object of the invention is to provide a high frequency antenna array which exhibits high front-to-back ratio, increased directivity gain, and one which provides a low angle of radiation in a single direction.

And yet another object of the invention is to provide a light weight portable antenna array which eliminates the requirement for an elaborate ground system or an impedance matching network.

SUMMARY

Accordingly, the foregoing and other objects are provided by a vertically polarized array comprised of a multi-segment square type driven antenna element located a predetermined distance above the surface of the earth and coupled to a feed point and including at least one horizontal half wavelength conductor segment and a pair of vertical quarter wavelength conductor segments which are extensions of or connected to the ends of the half wavelength segment and a substantially identical parasitic reflector configuration located a quarter wavelength behind and in substantial registration with the driven element. Both bottom fed and top fed configurations are embodied in the invention and the vertical quarter wavelength elements depend vertically to a position one or two feet above the surface of the earth.

BRIEF DESCRIPTION OF THE DRAWINGS

FIG. 3 is an electrical schematic diagram illustrative of a top fed embodiment of the invention;

FIG. 4 is a diagram illustrative of the current amplitude distribution on the antenna array shown in FIG. 3;

DESCRIPTION OF THE PREFERRED EMBODIMENTS

Figure 1:
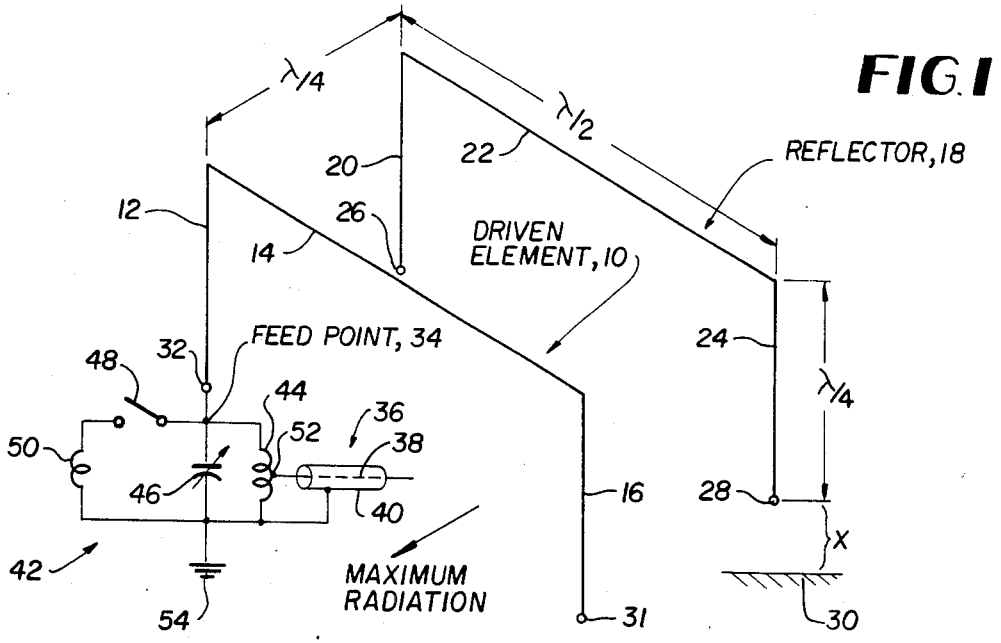
FIG. 1 is an electrical schematic diagram illustrative of a bottom fed embodiment of the invention.

Referring now to the drawings and more particularly to FIG. 1, shown thereat is a vertically polarized antenna array in accordance with one embodiment of the invention and one comprised of a multi-segment square type driven antenna element 10 comprised of three mutually square wire conductor segments 12, 14 and 16 and a substantially identical parasitic reflector element 18 comprising three mutually square conductor segments 20, 22 and 24, which is located approximately one quarter wavelength ($\lambda/4$) of the operating frequency of the array, behind the driven element 10.

Further as shown in FIG. 1, the horizontal wire conductor segment 14 of the driven element 10 and the horizontal wire conductor segment 22 of the reflector element 18 have a length which is substantially one half wavelength long while the vertical depending wire conductor segments 12 and 16 of the driven element 10 and the vertical wire conductor segments 20 and 24 of the reflector element 18 are substantially one quarter wavelength long. The two lower ends 26 and 28 of the two vertical conductor segments 20 and 24 do not terminate at the surface of the earth 30, but are positioned so that they are a foot or two above the surface as designated by the dimension x. The lower end 31 of vertical conductor 16 is likewise positioned; however, the lower end 32 of the vertical conductor 12 of the driven element 10 terminates in or is connected to a feed point 34 to which radio apparatus, not shown, is coupled. Coupling is further provided by a coaxial cable 36 consisting of an inner conductor 38 and an outer conductor 40 as well as a tuned circuit 42 comprised of the parallel combination of a tapped inductor 44 and a variable capacitor 46 which is used to establish resonance at the operating frequency of the array. Additionally, a single pole switch 48 is also provided enabling a second parallel inductor 50 to be coupled across the inductor 44 to effect tuning, when desired, at a relatively higher frequency.

The coaxial transmission line 36 which interconnects the radio apparatus and the feed point 34 provides a convenient method for transforming the high impedance of the antenna feed to the low impedance of the transmission line. This transformation, moreover, is accomplished by tapping, i.e. connecting the inner conductor 38 of the coaxial transmission line 36, to the inductor 44 at a predetermined point 52. The outer conductor 40 of the coaxial transmission line 36 is connected to a point of reference potential 54 which is illustrated as ground potential. Ground potential or simply "ground" can be established, for example, by a short metal rod driven into the earth 30 or it may consist of one or more radial wires, not shown, laid upon the surface of the earth 30 which forms thereby a ground plane. Because the antenna impedance at the feed point 34 is relatively high, in the order of several thousand ohms, it follows that the radio frequency (RF) current entering ground 54 is very small and accordingly, antenna efficiency will be very high due to reduced power loss in the earth. In reality only a rudimentary ground connection is actually required which greatly simplifies the construction and field installation of the array where it is to be utilized, for example, as a light weight man-portable antenna essential for certain military applications.

With the configuration shown in FIG. 1, relatively high unidirectional directivity gain can be obtained (6-dB) at a low radiation angle, e.g. 20° above the horizon. Furthermore, a front to back ratio (F/B) of approximately 9-db can be also achieved, an important consideration in reducing interference and probability of intercept where covert communications are required.

Where the antenna array of FIG. 1 utilizes half wavelength and quarter wavelength sections having dimensions, typically of 49 feet and 24.5 feet, respectively, for operating at a frequency of 10 MHz, the array is comparable to gain provided by a long wire antenna system which may be of the order of 600 feet in length. Thus a substantial advantage is realized in performance. The disadvantage is the narrow impedance-bandwidth which necessitates dimensioning the antenna for the intended operating frequency.

Figure 2:
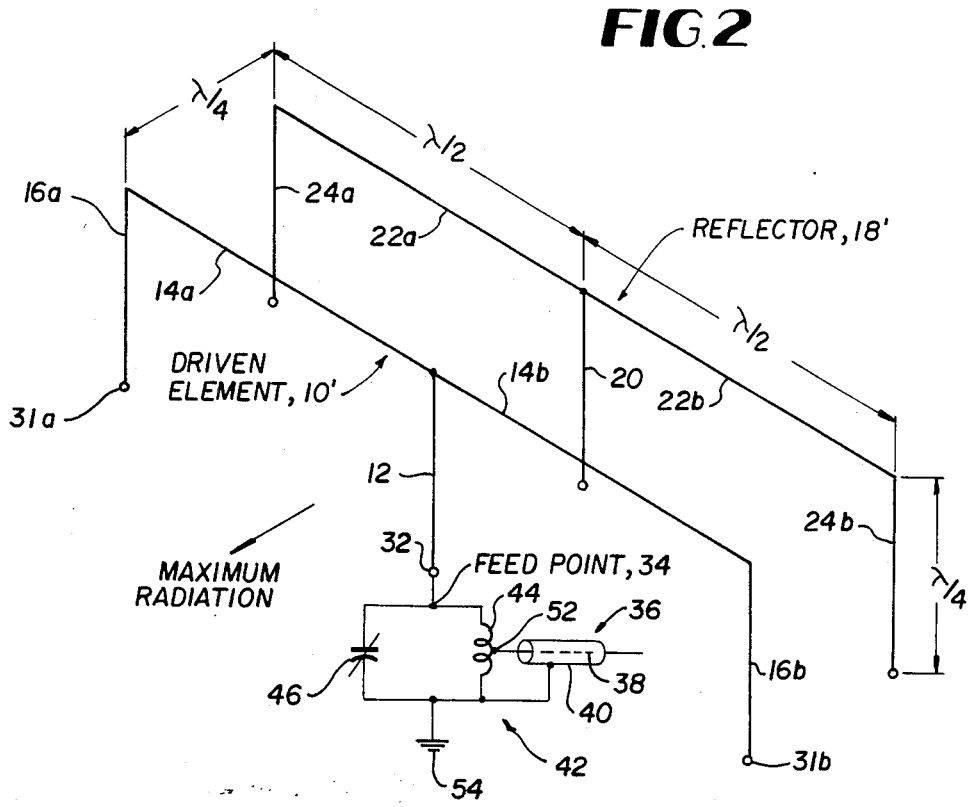
FIG. 2 is an electrical schematic diagram illustrative of another bottom fed embodiment of the invention.

Whereas the embodiment of FIG. 1 discloses a bottom fed half square array including a half square parasitic reflector located a quarter wavelength behind it, the embodiment of FIG. 2 discloses another bottom fed array which is essentially an expanded or double configuration of that shown in FIG. 1. This embodiment is shown comprising a driven element and a reflector element designated by reference numeral 10', 18', respectively. The driven element 10' includes a pair of generally horizontal half wavelength wire conductor segments **14*a* and 14*b* which are connected at their inner ends by a generally vertical quarter wavelength segment 12 and whose lower end 32 terminates in the feedpoint 34. The outer ends of the two half wavelength segments extend into or connect to two outer vertically depending quarter wavelength conductor segments 16*a* and 16*b*** whose lower ends approach but do not contact the surface of the earth.

In a like manner, the reflector 18' is comprised of two generally horizontal half wavelength conductor segments **22*a* and 22*b* whose inner ends are commonly connected to the vertical quarter wavelength segment 20 while the respective outer ends are integral with or connect to a pair of quarter wavelength conductor segments 24*a* and 24*b* which also extend to but do not make contact with the ground. The arrangement comprising the embodiment shown in FIG. 2 has the advantage of increasing the directivity gain over that of FIG. 1 in that the gain of this configuration is on the order of 8-dB at an angle 20° above the horizon over relatively flat or average earth surface. This increase in gain is attributable to the added driven and reflector components. Connection to radio apparatus, not shown, via transmission line 36 is provided in the same way as shown in FIG. 1 by tapping to the inductor 44 at point 52. Moreover, it has been found that once the tap location 52** has been fixed, it requires no adjustment over an octave frequency band.

While the broadside antenna arrays of FIGS. 1 and 2 disclose vertically polarized arrays which are bottom fed configurations, FIG. 3 discloses a top fed configuration which is similar to the embodiment shown in FIG. 1 in that it utilizes in the driven element 10, a horizontal half wavelength wire conductor 14 and outer vertical quarter wavelength segment 16; however, the other quarter wavelength conductor segment 12 of FIG. 1 is modified to comprise a quarter wavelength segment 12' of the coaxial transmission line 36 whose inner conductor 38 terminates at an upper feedpoint 56 which is coincident with one end 58 of the horizontal half wavelength conductor segment 14.

Moreover, the tuned circuit 42 at the lower end of the quarter wavelength segment 12, shown in both FIGS. 1 and 2, is replaced by a signal isolation device which comprises a broadband cable choke 60 and which in actuality consists in forming a portion of the transmission line 36 into a coil. This type of device is well known in the art, a typical example being shown and described in U.S. Pat. No. 3,961,331, entitled, "Lossy Cable Choke Broadband Isolation Means For Independent Antennas", which issued to Donn V. Campbell on June 1, 1976. The cable choke 60 operates to electrically decouple or isolate the bottom end of the coaxial quarter wavelength segment 12' from ground 54 which connects to the outer conductor 40 of the coaxial transmission line 36 on the radio side of the transmission line. This electrical decoupling or isolation feature occurs because the cable choke 60 is electrically equivalent to a high impedance circuit with respect to RF current flowing on the outside surface of the outer conductor 40; however, RF current flowing inside the transmission line about the inner conductor 38 is not affected by the choke and the ordinary TEM mode of propagation prevails. Because the cable choke 60 consists of a portion of the coaxial transmission line 36 formed into an inductance, and configured, for example, by winding the coaxial cable into a solenoidal coil or by winding it on a ferrous torroidal or rod shaped core, the choke comprises an impedance connected in series with the inner and outer conductors 38 and 40.

As a consequence of feeding the antenna array shown in FIG. 3 by means of the cable choke 60, the antenna is electrically equivalent to the schematic shown in FIG. 4 where the feedpoint 56 is located at the top of the vertical quarter wavelength member 12' which is actually the outer conductor 40 of the coaxial transmission line 36 shown in FIG. 3. The dashed line curves 62, 64 and 66 illustrate the instantaneous amplitude distribution of the RF current supported by the driven element conductor segments 12', 14 and 16. The arrows depict the phase and direction of these RF currents and furthermore indicate that the RF currents in the two vertical segments 12' and 16 are in phase. Moreover, the current amplitude is maximum at the feedpoint 56 which is also the highest point above the ground. This is a major advantage because it reduces power loss in the earth and favors low angle radiation needed to support medium range and long range ionospheric propagation. Another major advantage of the antenna system of FIG. 3 is realized due to the fact that the antenna array is fed at a point 56 where the RF current is at a maximum. Because of this feature, the radio apparatus connected across the terminals 68 and 70 via the coaxial transmission line 36 is well matched to the antenna and it becomes unnecessary to employ any further impedance matching circuit since the voltage standing wave ratio (VSWR) is very low, typically less than 2:1 at the resonance frequency of the antenna array. Furthermore, experience has indicated that a high frequency cable choke can be designed to be effective over an octave bandwidth or more. This bandwidth feature means that the antenna system disclosed in FIG. 3 employing a cable choke requires no adjustment apart from dimensioning the resonances and correct spacing of the reflector elements 18 and the driven element 10.

Figure 5:
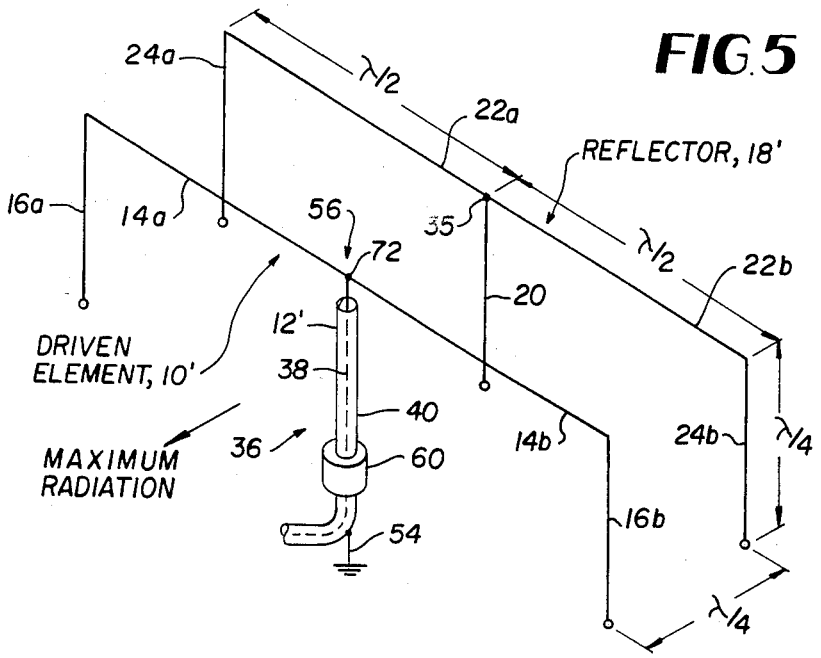
FIG. 5 is an electrical schematic diagram illustrative of another top fed embodiment of the invention.

Referring now to FIG. 5, there is shown a top fed embodiment of the subject invention similar to that shown with respect to FIG. 3 with the exception that it is expanded in the manner of FIG. 2. As shown, the embodiment of FIG. 5 includes a driven element 10' comprised of two horizontal half wavelength conductor segments **14*a* and 14*b* which are connected at a junction 72 and having a pair of vertically depending quarter wavelength segments 16*a* and 16*b* which are either extensions of or are connected to the outer ends of segments 14*a* and 14*b*. The reflector element 18' is identical to that shown in FIG. 2 in that it includes a pair of half wavelength conductor segments 22*a* and 22*b* which are mutually connected to an inner quarter wavelength vertical segment 20 and having a pair of outlying quarter wavelength vertical segments 24*a* and 24*b* extending from the ends of the horizontal segments 22*a* and 22*b*. As in the case of the embodiment shown in FIG. 3, a quarter wavelength section 12' of the coaxial transmission line 36 has its lower end formed into a cable choke 60**.

Figure 6:
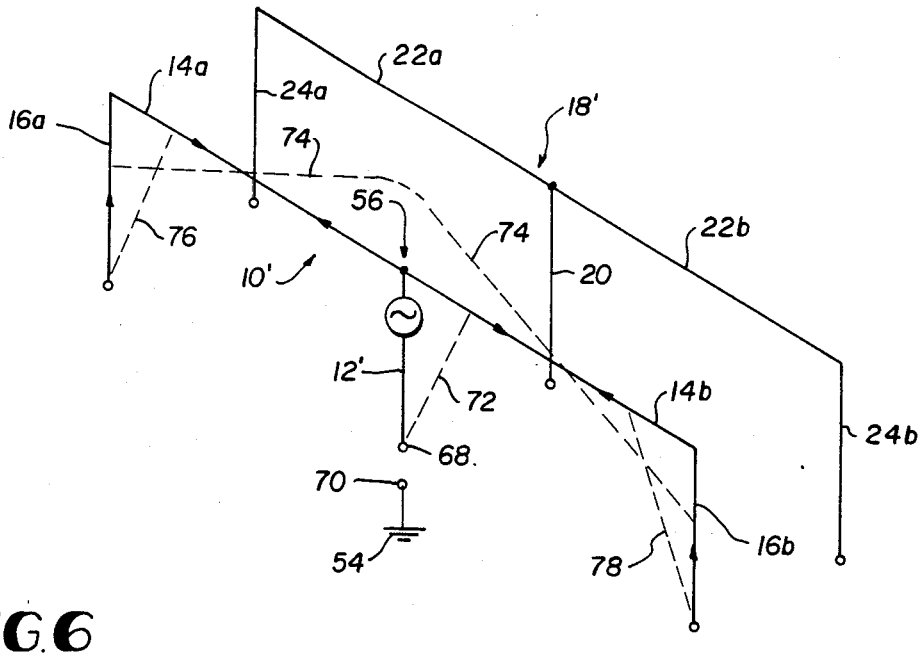
FIG. 6 is a diagram illustrative of the current amplitude distribution on the antenna shown in FIG. 5.

The antenna system of FIG. 5 is electrically equivalent to that shown in FIG. 6 where the feedpoint 56 is located at the top of the central vertical member 12', which as in the case of the embodiment shown in FIG. 3, comprises the outer conductor 40 of the transmission line 36 above the cable choke 60. Referring now briefly to FIG. 6, the dashed line curves 72, 74, 76 and 78 illustrate the instantaneous amplitude distribution of the RF current on the various segments of the driven element 10'. The small arrows, moreover, indicate the direction and phase of these RF currents. Again, the current amplitude on the antenna is maximum at the highest point above the ground resulting in reduced power loss in the ground and enhanced lower radiation. The input impedance is on the order of 50 ohms and the antenna array shown in FIG. 5 requires no impedance matching circuit due to the fact that the VSWR is extremely low. The gain of the array shown in FIG. 5 is on the order of 8-dB at an angle of 20° above the horizon, assuming an average conductivity of the earth. The front to back ratio (F/B) is approximately 13-dB.

Figure 7:
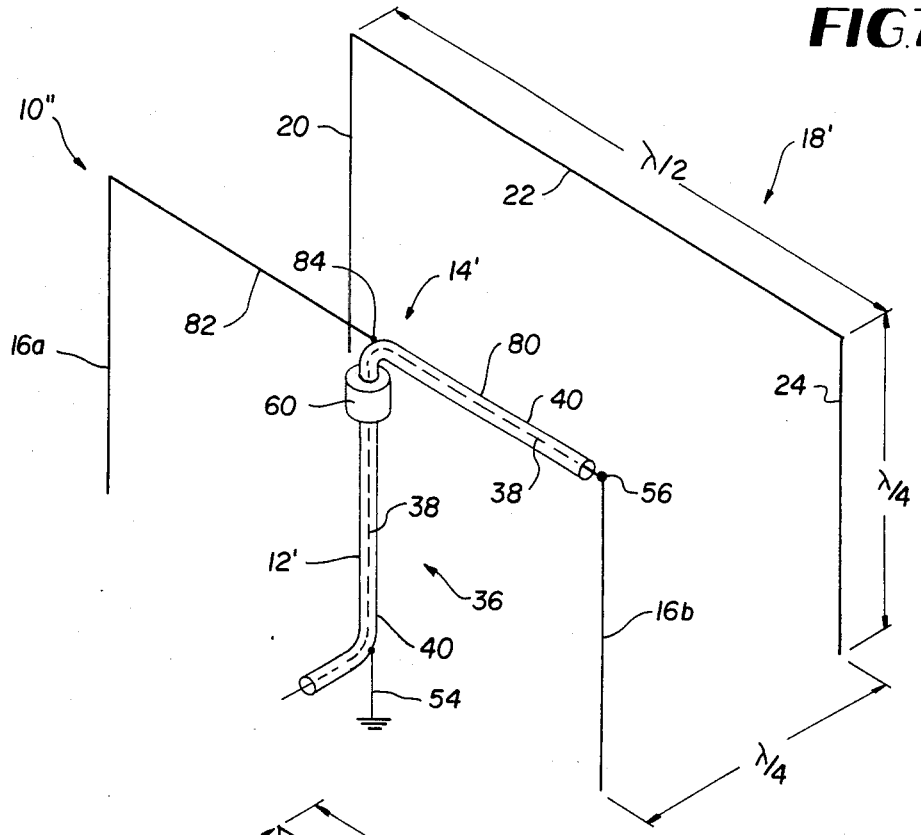
FIG. 7 is an electrical schematic diagram of yet another top fed embodiment of the invention.

Another top fed embodiment of the invention is shown in FIG. 7. There, however, a quarter wavelength section 80 of the coaxial transmission line 36 forms one half of the horizontal half wavelength driven antenna segment 14' in conjunction with a horizontal quarter wavelength section of wire 82 with vertically depending quarter wavelength segments **16*a* and 16*b* forming an integral part of or connected to the segment 82 or the inner conductor 38 of the coaxial cable section 80, respectively. The cable choke 60 now, however, is located at the upper end of the vertical coaxial quarter wavelength section 12' of the transmission line 36. The exposed tip of the inner conductor 38 of the transmission line section 80 now comprises the feedpoint 56. The parasitic reflector 18' is identical to that shown in FIG. 3 and comprises the generally horizontal half wavelength segment 22, together with the pair of vertically depending quarter wavelength segments 20 and 24**.

The configuration in FIG. 7 operates essentially the same as that for the embodiment shown in FIG. 3; however, in this case the cable choke 60 prevents RF current flow on the outer conductor 40 of the vertical quarter wavelength segment 12'. The advantage of the configuration of FIG. 7 is that it allows somewhat greater flexibility in dimensioning the wires making up the array. For example, when dimensioning an existing antenna for a different wavelength, the length of the vertical transmission line segment 12' is easily changed, whereas the length of the horizontal transmission line segment 80 may not be changed for moderate alterations of the antenna provided that the members **16*a*, 16*b*, 82, 20, 22 and 24 are properly adjusted. This is possible because the current amplitude at the feedpoint 56** and consequently the input impedance does not change substantially.

Figure 8:
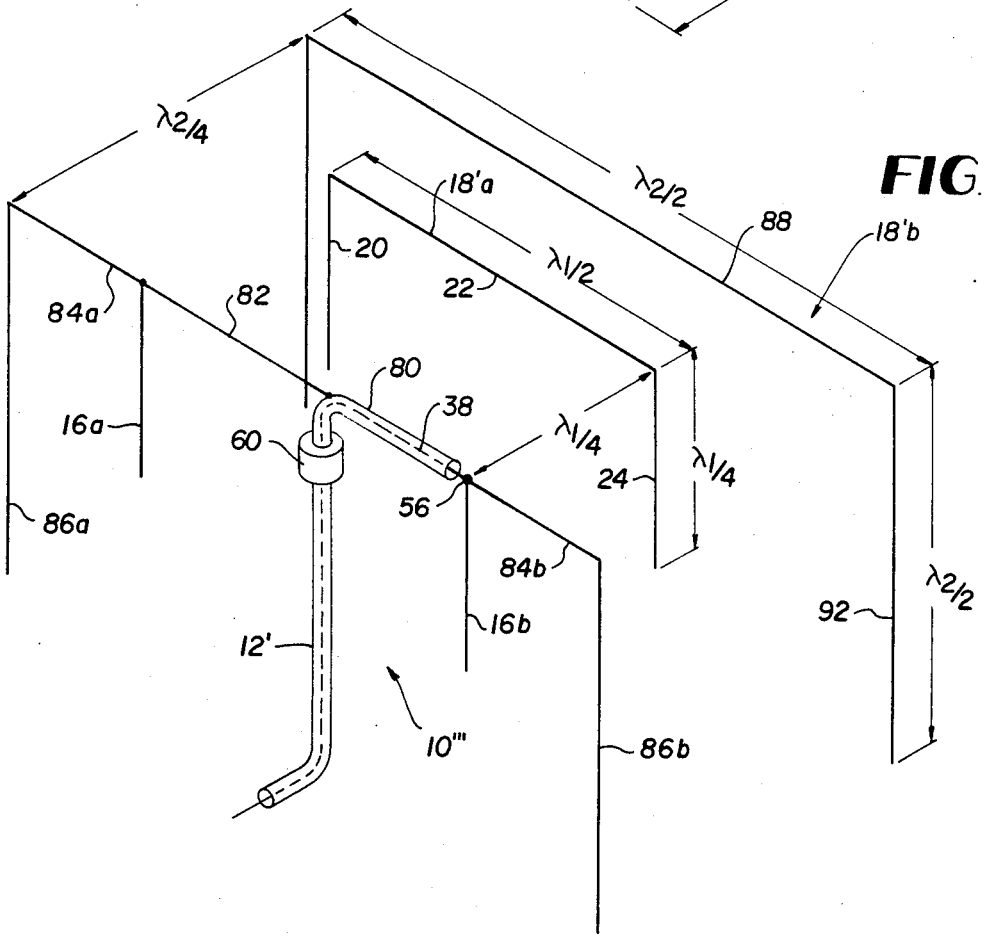
FIG. 8 is an electrical schematic diagram of still another top fed embodiment of the invention.

It is additionally possible to take advantage of the fact that the input impedance of the top fed antenna configuration does not change significantly provided that the feedpoint remains sufficiently close to the current maximum. This makes it possible to achieve antenna operation on several different wavelengths by proper dimensioning. For example, the driven element can be arranged to permit excitation at two frequencies corresponding to the resonance of the various wire members as shown by the embodiment of FIG. 8 which is essentially the configuration of FIG. 7 but with the addition of a pair of conductor segments **84*a* and 84*b* extending beyond the horizontal wire segment 82 and the inner conductor 38 of the coaxial transmission line segment 80 to define a second half wavelength conductor for operating at a frequency of wavelength $\lambda_2$. This additionally requires a second pair of vertically depending quarter wavelength ($\lambda_2/4$) wire segments 86*a* and 86*b* for the driven element which is shown by reference numeral 10'''. This configuration, moreover, requires in addition to the $\lambda_1$ reflector 18'*a*, a second parasitic reflector 18'*b* comprised of the horizontal conductor segment 88 having a length $\lambda_2/2$ and two outlying quarter wavelength segments 92 and a like segment at the other end. It should be noted that the two parasitic reflector elements 18'*a* and 18'*b* are required to be separated from the driven element 10''** by being one quarter wavelength of the respective operating wavelength $\lambda_1$ and $\lambda_2$ behind the driven element.

Thus what has been shown and described is an improvement in multi-element broadside vertical arrays which lend themselves to particular use in a military tactical environment where simplicity in installation and operation is essential.

Having thus shown and described what is at present considered to be the preferred embodiments of the invention, it should be understood that they have been disclosed by way of illustration and not limitation. Accordingly, all modifications, alterations and changes coming within the spirit and scope of the invention are herein meant to be included.

We claim:

1. A vertically polarized broadside antenna array comprising:

a mutually square multi-segment antenna including a driven element located at a predetermined distance above the surface of the earth and point of ground reference potential, said driven element having at least one generally horizontal half wavelength segment and at least two vertical quarter wavelength segments located at and electrically connected to the respective ends of said half wavelength segment;

a top feedpoint located at the connection of the upper end of one of said vertical quarter wavelength segments with one end of said half wavelength segment; and signal feed means feeding radio frequency signals to said top feedpoint including signal isolation means for isolating said signal from said ground reference.

2. The antenna array as defined by claim 1 including a parasitic reflector element spaced at a quarter wavelength from said driven element and having an electrical conductor configuration substantially the same as and in registration with said driven element.

3. The antenna array as defined by claim 1 and wherein said point of reference potential includes a metallic element in the earth.

4. The antenna array as defined by claim 2 wherein said parasitic reflector element includes a generally horizontal half wavelength conductor segment and a pair of generally vertical quarter wavelength conductor segments located at and electrically connected to the ends of said half wavelength segment and with the opposite ends of said quarter wavelength segments approaching but not contacting the surface of the earth.

5. The antenna array as defined by claim 1 wherein said signal feed means is a length of coaxial transmission line.

6. The antenna array as defined by claim 5 wherein said signal isolation means is a cable choke formed of a portion of said coaxial transmission line.

7. The antenna array as defined by claim 6 wherein said coaxial transmission line is a quarter wavelength section including an inner and outer conductor, said feedpoint being located at the top end of said inner conductor thereof and the other end of said section including said signal isolation means, said outer conductor being connected to said ground reference.

8. The antenna array as defined by claim 7 wherein said quarter wavelength inner conductor forms a portion of said horizontal half wavelength segment connected to said upper feedpoint of one vertical segment, said half wavelength segment including a second substantially horizontal quarter wavelength conductor segment having one end connected to the other end of the outer conductor of said quarter wavelength section of coaxial transmission line at said signal isolation means and a substantially vertical quarter wavelength section of coaxial transmission line depending from said signal isolation means.

9. The antenna array as defined by claim 7 wherein said quarter wavelength coaxial line inner conductor forms said one quarter wavelength segment.

10. The antenna array as defined by claim 9 wherein said driven antenna element additionally includes a second generally horizontal half wavelength segment connected at one end to said one half wavelength segment at the point of connection with the upper end of said one vertical quarter wavelength segment including said feedpoint, and a third generally vertical quarter wavelength segment located at and electrically connected to the other end of said second half wavelength segment.

11. The antenna array as defined by claim 6 including a spaced parasitic reflector element having a pair of substantially horizontal half wavelength segments joined at one end to a first generally vertical quarter wavelength segment, and second and third generally vertical quarter wavelength segments respectively joined to the other respective ends of said horizontal half wavelength segments and with ends of said quarter wavelength segments approaching but not contacting the surface of the earth.

12. The antenna array as defined by claim 8 wherein said horizontal quarter wavelength section of coaxial transmission line and said second horizontal quarter wavelength conductor segment connected to the outer conductor thereof define a half wavelength of a first operating frequency of the array and said two vertical quarter wavelength segments define a quarter wavelength of said first operating frequency, and additionally including at least two quarter wavelength sections of generally horizontal conductor segments respectively coupled to said feedpoint and to the outer end of said second horizontal quarter wavelength section of first operating frequency to define a half wavelength horizontal segment of a second operating frequency, and at least two generally vertical quarter wavelength segments of said second operating frequency located at and electrically connected to the ends of said horizontal half wavelength segment of second operating frequency.

13. The antenna array as defined by claim 12 including parasitic reflector means having first and second reflector elements, said first reflector element including a generally horizontal half wavelength conductor segment of said first operating frequency and a pair of generally vertical quarter wavelength conductor segments of said first operating frequency located at and electrically connected to the ends of said half wavelength segment of first operating frequency and located behind said driven element substantially a quarter wavelength of said first operating frequency and with the ends of said quarter wavelength segments of first operating frequency approaching but not contacting the surface of the earth, said second reflector having a generally horizontal half wavelength conductor segment of said second operating frequency and a pair of generally vertical quarter wavelength conductor segments of said second operating frequency located at and electrically connected to the ends of said half wavelength segment of second operating frequency and wherein said second parasitic reflector is located behind said driven antenna elements substantially a quarter wavelength of said second operating frequency and with the ends of said quarter wavelength segments of second operating frequency also approaching but not contacting the surface of the earth.

* * * * *